US008147027B2

(12) United States Patent
Hara

(10) Patent No.: US 8,147,027 B2
(45) Date of Patent: Apr. 3, 2012

(54) INK JET PRINTING APPARATUS AND INK JET PRINTING METHOD

(75) Inventor: Katsushi Hara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 899 days.

(21) Appl. No.: 12/023,481

(22) Filed: Jan. 31, 2008

(65) Prior Publication Data

US 2008/0186344 A1 Aug. 7, 2008

(30) Foreign Application Priority Data

Feb. 2, 2007 (JP) ..... 2007-024723

(51) Int. Cl.
*B41J 2/165* (2006.01)

(52) U.S. Cl. ..... 347/23

(58) Field of Classification Search ..... 347/14, 347/23

See application file for complete search history.

(56) References Cited

U.S. PATENT DOCUMENTS 4,967,204 A * 10/1990 Terasawa et al. ..... 347/23
5,266,975 A * 11/1993 Mochizuki et al. ..... 347/23
5,379,061 A * 1/1995 Yamaguchi et al. ..... 347/23
5,559,539 A * 9/1996 Vo et al. ..... 347/33
5,896,143 A 4/1999 Matsui et al. ..... 347/24
6,033,050 A * 3/2000 Morita et al. ..... 347/23
6,082,854 A 7/2000 Axtell et al. ..... 347/108
6,126,265 A * 10/2000 Childers et al. ..... 347/23
6,193,351 B1 2/2001 Yaegashi et al. ..... 347/23
6,234,626 B1 5/2001 Axtell et al. ..... 347/108
6,257,717 B1 7/2001 Axtell et al. ..... 347/108

(Continued)

FOREIGN PATENT DOCUMENTS

JP 2001-205825 A 7/2001

(Continued)

OTHER PUBLICATIONS

Notification of First Office Action in Chinese Application No. 2008/100070776, Chinese Patent Office (Jun. 26, 2009), with English Translation.

(Continued)

*Primary Examiner* — Charlie Peng

(74) *Attorney, Agent, or Firm* — Fitzpatrick, Cella, Harper & Scinto

(57) ABSTRACT

An ink jet printing apparatus and an ink jet printing method are provided which can perform ink ejection performance recovery operations on a print head at optimal timings while at the same time reducing a volume of ink discarded by the recovery operations. Thirty days after a previous recovery operation, a suction-based recovery operation is performed on the print head prior to the printing operation that forms an image on a print medium. The recovery operation is performed under the condition that a temperature increase of the print head caused by a preliminary ejection of the print head is not more than a predetermined value.

5 Claims, 11 Drawing Sheets

U.S. PATENT DOCUMENTS

| | | | | |
|---|---|---|---|---|
| 6,264,322 | B1 | 7/2001 | Axtell et al. | 347/108 |
| 6,283,574 | B1 * | 9/2001 | Sugimoto et al. | 347/23 |
| 6,338,540 | B1 * | 1/2002 | Hasegawa et al. | 347/23 |
| 6,398,336 | B1 * | 6/2002 | Yoda et al. | 347/23 |
| 6,896,349 | B2 * | 5/2005 | Valero et al. | 347/22 |
| 7,121,645 | B2 | 10/2006 | Hara | 347/30 |
| 7,185,965 | B2 | 3/2007 | Takada et al. | 347/17 |
| 7,222,933 | B2 | 5/2007 | Takada et al. | 347/17 |
| 2002/0027574 | A1 | 3/2002 | Kao et al. | |
| 2002/0060710 | A1 | 5/2002 | Iwata et al. | 347/23 |
| 2004/0100519 | A1 * | 5/2004 | Kikuchi et al. | 347/23 |
| 2005/0174382 | A1 * | 8/2005 | Yoshikawa et al. | 347/30 |
| 2005/0264602 | A1 | 12/2005 | Mizuno | |
| 2007/0008368 | A1 | 1/2007 | Maru et al. | 347/19 |

FOREIGN PATENT DOCUMENTS

| | | |
|---|---|---|
| JP | 2003-182052 | 7/2003 |
| JP | 2005-335238 | 12/2005 |
| RU | 2207958 C2 | 7/2003 |

OTHER PUBLICATIONS

Decision on Grant, Application No. 2008103958/12(004296) (Apr. 24, 2009).

Japanese Office Action dated Mar. 4, 2011, issued in counterpart Japanese patent application No. 2007-024723.

* cited by examiner

| ELAPSED TIME FROM START OF PRELIMINARY EJECTION | 0.1sec | 0.2sec | 0.3sec | 0.4sec | 0.5sec | 0.6sec | 0.7sec | 0.8sec | 0.9sec | 1.0sec |
|---|---|---|---|---|---|---|---|---|---|---|
| THRESHOLD ($\Delta Ts$) | 3°C | 6°C | 9°C | 12°C | 15°C | 18°C | 21°C | 24°C | 27°C | 30°C |

FIG.6

INK JET PRINTING APPARATUS AND INK JET PRINTING METHOD

BACKGROUND OF THE INVENTION

1. Field of the Invention

The present invention relates to an ink jet printing apparatus and an ink jet printing method to form an image on a print medium using a print head that has a plurality of ink ejection openings.

2. Description of the Related Art

In an ink jet printing apparatus that forms an image on a print medium by ejecting ink droplets, a print head is used that has a plurality of fine ink ejection openings and liquid paths communicating to the openings (a combination of each ink ejection opening and its associated liquid path is also called a "nozzle"). When a bubble is present in a nozzle or liquid path of such a print head, an ink ejection performance of the print head may deteriorate. More specifically, the presence of a bubble may result in an ink droplet failing to be ejected from the print head or an ejected ink droplet deflecting from an intended direction, causing a landing position error. A bubble may be produced in the print head when external air enters from an ink ejection opening into a liquid path filled with ink or when it enters into a tube filled with ink and further into the print head. Also in a print head that ejects ink by an expanding force of a generated bubble, there is also a possibility that minute air residues may accumulate to form a bubble in the nozzle.

To avoid such an ink ejection performance degradation due to air present in the print head, a recovery operation to clear the nozzles and liquid paths of residual air by refreshing ink in the nozzles has been performed.

One such recovery operation uses a cap capable of covering an ejection opening formation face of the print head and a pump connected to the cap. This operation involves covering the ejection opening formation face with the cap and introducing a negative pressure produced by the pump into the cap to forcibly suck out ink from the nozzles of the print head into the cap. This recovery operation is also called a "suction-based recovery operation". Other recovery operations include a preliminary ejection operation which ejects ink not contributing to image printing from the ejection openings of the print head, and a wiping operation that wipes the ejection opening formation face. These recovery operations, such as suction-based recovery operation, preliminary ejection operation and wiping operation, are executed in combination.

Of the air present in the nozzles of the print head, air that has entered from the ejection openings into the liquid paths and air that has entered into a tube may increase in volume over time. Generally, the above recovery operation is performed at predetermined intervals to prevent the degradation in the ejection performance of the print head caused by the trapped air. A control to execute the recovery operation at predetermined intervals is also called an "automated timer recovery control".

This automated timer recovery control, however, has the following problem. Since the recovery operation is performed at predetermined intervals, a certain amount of ink is discharged every time the recovery operation is performed. This in turn increases a running cost and makes it necessary to increase a waste ink tank for collecting the discharged ink.

The amount of air trapped in the liquid paths and tube varies depending not only on the elapse of time but also on the environment and condition in which the printing apparatus is used. That is, the interval between the recovery operations varies according to the environment and condition of use of the printing apparatus. In the automated timer recovery control, however, the recovery operation is set to be executed at relatively short intervals to ensure that the recovery operation is initiated early to reliably prevent the ejection performance degradations. So, the recovery operation is performed more than necessary, which in turn increases the volume of ink consumed by the recovery operations. Reducing the volume of waste ink that is discarded more than necessary is now a grave issue in terms of the running cost. Particularly, for a user who prints an image only rarely, since the volume of ink actually used for printing is not so large, a ratio of the ink volume discarded by the recovery operation to the total ink consumption becomes high. For such a user, the running cost is even higher.

Japanese Patent Laid-Open No. 2003-182052 proposes a construction that enables a user to choose between an execution of a recovery operation by the automated timer recovery control and a prohibition of execution. Japanese Patent Laid-Open No. 2005-335238 proposes a construction that controls the interval between recovery operations according to the state of printing.

However, the ink jet printing apparatus described in the Japanese Patent Laid-Open No. 2003-182052 simply allows the user to choose between the execution of recovery operation based on the automated timer recovery control and the prohibition of execution. So, once the user selects the prohibition of execution, the recovery operation based on the automated timer recovery control is not executed until the prohibition is reset. In that case, although the ink volume discarded by the recovery operation can be reduced substantially, the print head's ejection performance will likely deteriorate because no recovery operation is executed. When the ejection performance of the print head deteriorates, a quality of printed image will also deteriorate.

In the ink jet printing apparatus described in Japanese Patent Laid Open No. 2005-335238,the interval at which to perform the recovery operation is controlled by the automated timer recovery control according to the printing state, such as the kind of an image being printed and the time that has elapsed from the previous printing operation. If the interval of the recovery operation is set long by this control, the timing of execution is delayed from when the recovery operation is normally executed by the automated timer recovery control. The ejection performance of the print head during the delay period of execution timing is presumed to be maintained at a proper level in a general condition of use. However, depending on the condition of use of the printing apparatus by the user, the ejection performance of the print head may deteriorate. Therefore, it is difficult to perfectly guarantee the ejection performance of the print head depending on the environment of use of the printing apparatus and the printing state.

SUMMARY OF THE INVENTION

The present invention provides an ink jet printing apparatus and an ink jet printing method capable of performing a recovery operation at an optimal timing while at the same time reducing a volume of waste ink discarded by the recovery operation of the print head.

In a first aspect of the present invention, there is provided an ink jet printing apparatus adapted to print an image on a print medium by using a print head capable of ejecting ink from a plurality of ejection openings, the ink jet printing apparatus comprising: a recovery unit that performs a recovery operation to maintain an ink ejection performance of the print head following expiry of a first predetermined period; an acquisition unit that acquires information on first and second parameters relating to operation of the printing apparatus; and a control unit that is operable, when the first predetermined period expires and the acquired information indicates that the second parameter meets a second predetermined criterion, to cause the recovery unit to perform such a recovery operation, and when the first predetermined period expires and the acquired information indicates that the second parameter does not satisfy the second predetermined criterion, the control unit is operable to cause the recovery unit to perform such a recovery operation if the recovery operation on the print head is determined necessary based on the acquired information on the first parameter.

In a second aspect of the present invention, there is provided an ink jet printing method of printing an image on a print medium by using a printing apparatus having a print head capable of ejecting ink from a plurality of ejection openings, the ink jet printing method comprising the steps of: acquiring information on first and second parameter relating to operation of the printing apparatus; and when the first predetermined period expires and the acquired information indicates that the second parameter meets a second predetermined criterion, the recovery operation is performed, and, when the first predetermined period expires and the acquired information indicates that the second parameter does not meet the second predetermined criterion, the recovery operation is performed if the recovery operation is determined necessary based on the acquired information on the first parameter.

With this invention, a recovery operation of the print head, which is performed, after a predetermined period has elapsed, prior to a print operation that forms an image on a print medium, if information on the ink ejection state of the print head satisfies a predetermined condition. This makes it possible to perform the recovery operation at an optimal timing while at the same time reducing a volume of waste ink discarded by the recovery operation of the print head.

Further features of the present invention will become apparent from the following description of exemplary embodiments (with reference to the attached drawings).

BRIEF DESCRIPTION OF THE DRAWINGS

FIG. 6 is an explanatory diagram showing thresholds used in the decision procedure of FIG. 5;

DESCRIPTION OF THE EMBODIMENTS

Now embodiments of this invention will be described in detail by referring to the accompanying drawings.

Figure 1:
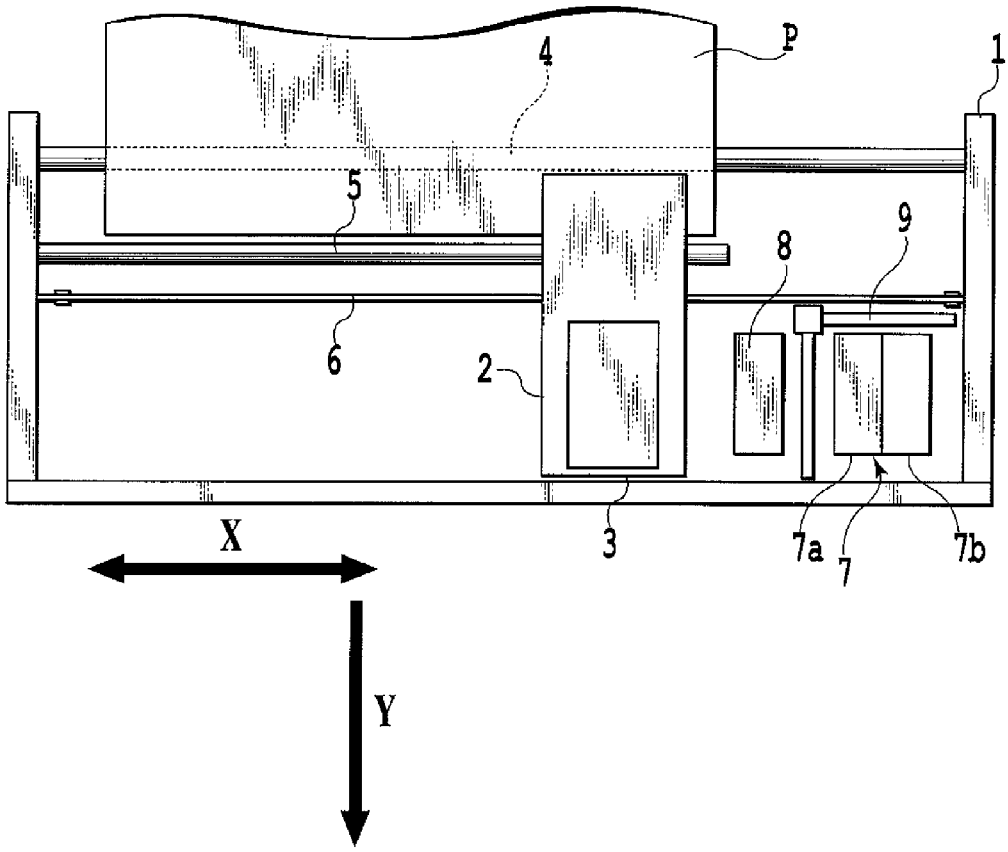
FIG. 1 is a plan view of an ink jet printing apparatus according to an embodiment of this invention.

FIG. 1 is a plan view showing a mechanical construction of the ink jet printing apparatus to which the present invention can be applied.

In FIG. 1, reference numeral 1 represents a printing apparatus body having a variety of mechanisms. Among the mechanisms is a conveying unit (not shown) that conveys a print medium P, such as print paper, in a sub-scan direction of arrow Y. The printing apparatus body 1 and a control system described later that is mounted in the printing apparatus body constitute an ink jet printing apparatus. The ink jet printing apparatus in this embodiment is of a serial type, which forms an image on a print medium P by intermittently conveying the print medium P in the sub-scan direction by the conveying unit and by performing a printing scan of an ink ejection print head 3 as it moves in a main scan direction of arrow X. The print head 3 is removably mounted in a carriage 2 and is moved together with the carriage 2 in the main scan direction. The printing apparatus body 1 of this example is formed larger in the main scan direction to allow for printing of a relatively large-sized print medium (e.g., A1 size).

The carriage 2 is supported so that it can be moved along a guide shaft 4 extending in the main scan direction. The carriage 2 is also connected to an endless belt 5. The endless belt 5 is stretched in the main scan direction between, and wound around, pulleys (not shown) located at the left and right side of the body in FIG. 1. One of the pulleys is driven by a carriage motor (CR motor) to move the carriage 2 along with the endless belt 5 in the main scan direction.

Figure 2:
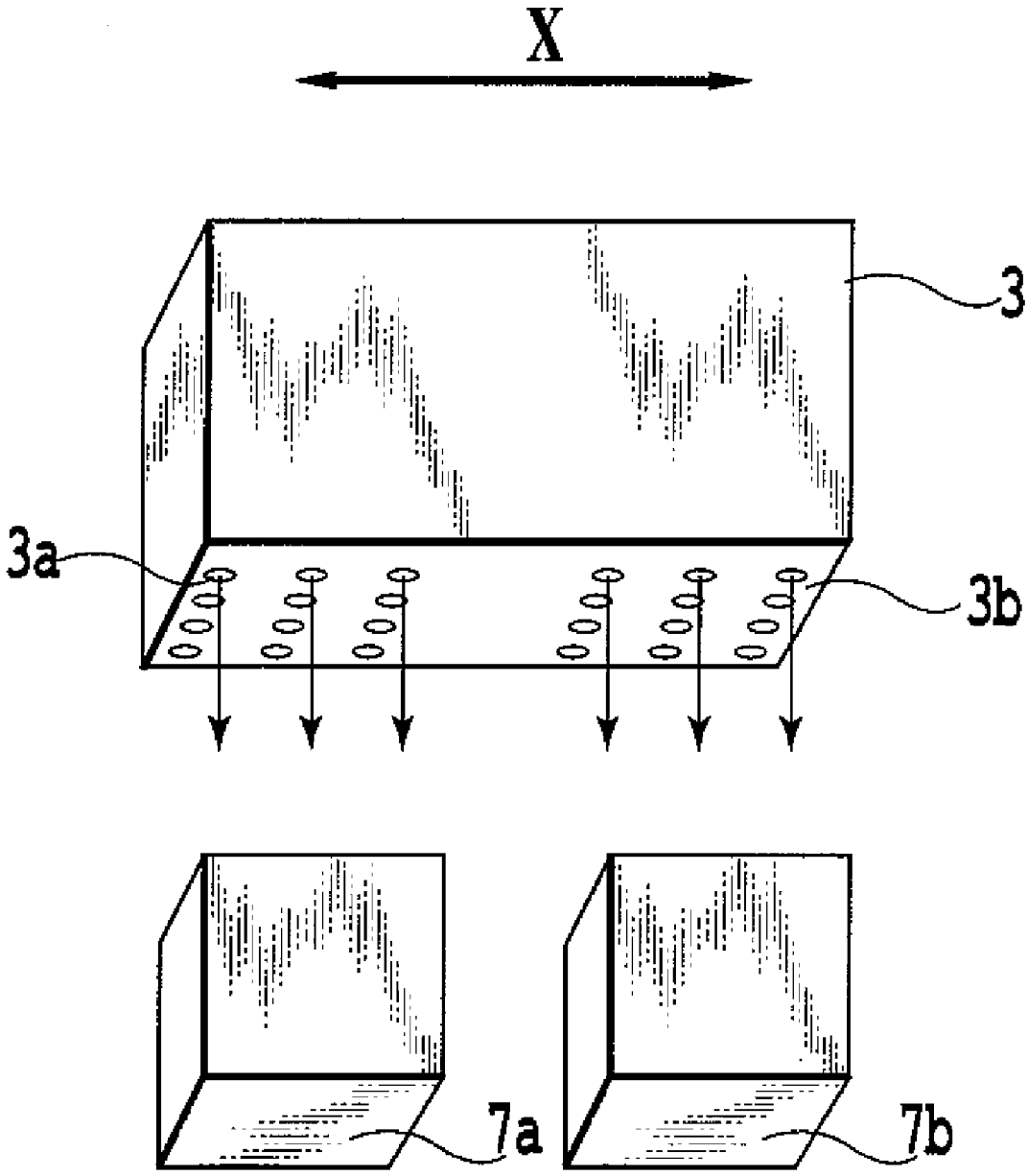
FIG. 2 is a schematic perspective view showing the print head and a suction-based recovery mechanism in the printing apparatus of FIG. 1.

The print head 3, as shown in FIG. 2, has a plurality of ejection openings 3*a* arrayed, in this example, in a direction crossing the main scan direction (ie., in a direction perpendicular to the main scan direction). In the schematic diagram of FIG. 2, six ejection opening lines each have four ejection openings 3*a* arrayed. The print head 3 is formed with a common liquid chamber to which ink is supplied and with a plurality of liquid paths through which ink is supplied from the common liquid chamber to individual ejection openings 3*a*. Each of the liquid paths is mounted with an energy generating element that generates an ejection energy to eject ink from the associated ejection opening 3*a*. In this example, an electrothermal converter is used as the energy generating element. The electrothermal converter locally heats ink to cause a film boiling which generates a pressure to eject ink from the ejection openings 3*a*. The energy generating element is not limited to the electrothermal converter but may also include an electromechanical converter such as a piezoelectric element. In the description that follows, an ejection opening 3*a* and its liquid path in combination are called a nozzle. A surface of the print head in which the plurality of ejection openings 3*a* are formed is called an ejection opening formation face 3*b*.

The print head 3 of this example has six nozzle groups (six ejection opening lines) of 2,560 ejection openings 3*a*. In each nozzle group, 2,560 ejection openings 3*a* are arrayed at a density of 1,200 dpi (dots/inch) in the sub-scan direction. Each nozzle group is supplied an ink of a different colorant. In this example, a total of five color inks—cyan, magenta, yellow, matte black and photo black—are supplied to respective nozzle groups. The matte black ink is supplied to two nozzle groups for the purpose of improving the printing speed (throughput). Thus, five color inks are ejected from six nozzle groups. In FIG. 2, the ejection openings 3*a* in one nozzle group are arrayed in one line. However, the ejection openings 3*a* in one nozzle group may be arranged in two lines. In that case, the two lines may each have 1,280 ejection openings 3*a* arrayed at a density of 600 dpi. The two lines may also have the positions of the ejection openings 3*a* staggered in the direction of line. This enables the printing at 1,200 dpi in the nozzle array direction.

In FIG. 1, reference numeral 7 represents a recovery operation device which performs a recovery operation on the print head 3 to maintain a print head performance of ejecting ink from the ejection openings 3*a*. The recovery operation device 7 is held and secured at a predetermined position in the printing apparatus body 1 and has suction-based recovery mechanisms 7*a*, 7*b*, a wiping recovery mechanism 9, a raise-lower mechanism (not shown) to raise or lower these mechanisms, and a preliminary ejection ink receiving case 8.

The suction-based recovery mechanisms 7*a*, 7*b* perform a suction-based recovery operation, one form of recovery operation. The suction-based recovery operation involves forcibly sucking out ink from a plurality of nozzles formed in the print head 3 to replace the ink in the nozzles with ink fit for ejection. More specifically, the suction-based recovery mechanisms 7*a*, 7*b* are each provided with a cap capable of closing the ejection openings 3*a*. First, the caps are raised to cover the ejection opening formation face 3*b* to close (or cap) the ejection openings 3*a*. Then, a pump connected to the caps is activated to produce a negative pressure, which is introduced into the caps to forcibly suck ink out of the ejection openings 3*a* into the caps. Each of the caps for the suction-based recovery mechanisms 7*a*, 7*b* can cap three nozzle groups and perform the suction-based recovery operation on them.

Another form of recovery operation is a preliminary ejection. The preliminary ejection involves ejecting ink not contributing to image printing from the ejection openings 3*a* toward the ink receiving case 8 to keep the ink in the nozzles of the print head 3 fit for ejection at all times. For example, when the viscosity of ink in the nozzles has risen as a result of a volatile component in the ink evaporating from the ejection openings 3*a*, the preliminary ejection may be performed to discharge the viscous ink from the nozzles. This preliminary ejection is basically performed immediately before or after a printing operation or at the end of the suction-based recovery operation. The preliminary ejection may also be executed during the printing operation at predetermined intervals.

Still another form of recovery operation is a wiping operation. This wiping operation involves wiping off ink and dirt adhering to the ejection opening formation face 3*b* of the print head 3. In this example, the wiping operation is performed by the wiping recovery mechanism 9. The wiping recovery mechanism 9 is installed at a position where it faces the print head 3 in the vertical direction when the print head 3 has moved to the predetermined position on its travel path. The wiping recovery mechanism 9 is provided with a blade (wiping member) and a blade drive mechanism for moving the blade in a direction of line of ejection openings of the print head 3 (direction Y). The blade, when driven by the blade drive mechanism, wipes the ejection opening formation face 3*b* of the print head 3.

Figure 3:
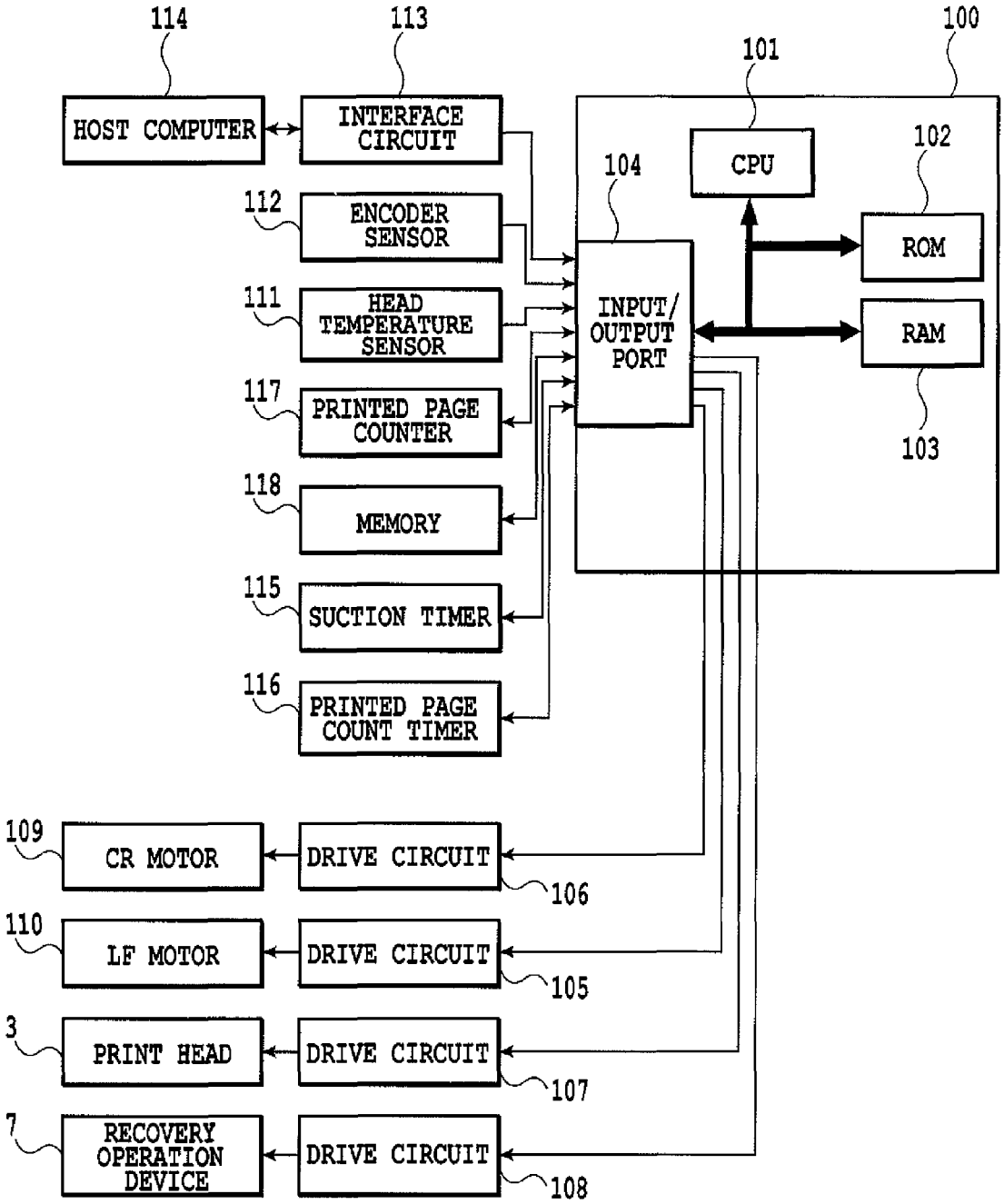
FIG. 3 is a block configuration diagram showing a control system in the printing apparatus of FIG. 1.

FIG. 3 is a block configuration diagram showing a control system (control unit) installed in the body 1 of the ink jet printing apparatus of FIG. 1.

In FIG. 3, a main control unit 100 has a CPU 101 for executing computation, control, decision, setting, etc. and a ROM 102 for storing control programs to be executed by the CPU 101. The main control unit 100 also has a RAM 103 and an input/output port 104. The RAM 103 is used as a buffer for storing binary print data representing ink ejection/non-ejection and also as a work area for the CPU 101 processing.

The input/output port 104 is connected with a drive circuit 105 for a conveying motor (LF motor) 110 in the conveying unit and with a drive circuit 106 for a carriage motor (CR motor) 109 to drive the carriage 2. Also connected with the input/output port 104 are a drive circuit 107 for the print head 3 and a drive circuit 108 for the recovery operation device 7. Further, the input/output port 104 is connected with a head temperature sensor (head temperature detection unit) 111 and with a variety of sensors such as an encoder sensor 112 fixed to the carriage 2. The encoder sensor 112 faces an encoder film 6 (see FIG. 1) arranged at a predetermined position in the printing apparatus body 1.

The main control unit 100 is connected to a host computer (host device) 114 through an interface circuit 113. The printing apparatus of this embodiment prints an image based on image data supplied from the host computer 114.

Denoted 115 is a suction timer used by an automated timer recovery control described later. The suction timer 115 clocks an elapsed time from the previous suction-based recovery operation. When the elapsed time has exceeded a predetermined length of time, the main control unit 100 decides that the suction-based recovery operation should be performed according a flow chart described later and causes the recovery operation device 7 to execute the suction-based recovery operation through the drive circuit 108. After the suction-based recovery operation is normally finished, the suction timer 115 is reset to restart clocking from "0". When the suction-based recovery operation is initiated at other timing, for example, when the suction-based recovery operation is forcibly initiated by an instruction from the user (manual suction-based recovery operation), the suction timer 115 is also reset to restart the clocking from "0".

Denoted 116 is a printed page count timer to clock a predetermined period (in this example, 30 days). This printed page count timer 116 is set to start at time of shipping of the printing apparatus and its clocked time is automatically cleared each time the predetermined period (in this example, 30 days) passes. Denoted 117 is a printed page counter to count the number of sheets of print medium P printed in the predetermined period (in this example, 30 days) clocked by the printed page count timer 116. When the printed page count timer 116 has reached the predetermined period, the printed page counter 117 resets the count value to restart the counting from "0". That is, the count value of the printed page counter 117 is cleared each time the clocked time of the printed page count timer 116 is cleared. The main control unit 100 checks, according to a flow chart described later, if the counted page number of the printed page counter 117 is more than a threshold (in this example, five), and stores the decision result in a memory 118.

Next, the printing operation and the automated timer recovery control executed by the above ink jet printing apparatus will be explained.

First, an outline of the printing operation will be explained.

Print data received from the host computer 114 via the interface circuit 113 is developed in a buffer of the RAM 103. Then, upon receiving an instruction for the printing operation, the printing apparatus starts the conveying unit to convey the print medium P to a position where it faces the print head 3. Next, the print head 3 ejects ink as it moves together with the carriage 2 in the main scan direction, forming one band of image on the print medium P. Then, the print medium P is conveyed a predetermined distance (e.g., one band) in the sub-scan direction by the conveying unit. The printing scan by the print head 3 and the print medium P conveying operation by the conveying unit are repetitively performed to form on the print medium P an image corresponding to the print data.

The main control unit 100 detects the position of the carriage 2 by counting pulse signals output from the encoder sensor 112 as the carriage 2 travels. That is, the encoder film 6 (see FIG. 1) extending in the main scan direction is formed with slits at predetermined intervals. The encoder sensor 112 on the carriage 2 produces a pulse signal when it detects the slit of the encoder film 6. The main control unit 100 counts the pulse signals to determine the position of the carriage 2. The control for moving the carriage 2 to the predetermined home position or other positions is performed based on the signal from the encoder sensor 112.

Next, the suction-based recovery operation executed by the automated timer recovery control will be explained.

The suction-based recovery operation is performed in the following sequence. First, the carriage 2 is moved until the ejection openings 3*a* of the print head 3 face the suction-based recovery mechanisms 7*a*, 7*b*, as shown in FIG. 2. Next, the suction-based recovery mechanisms 7*a*, 7*b* are raised to cover the ejection openings 3*a* with the caps (capping operation). Then, a pump mechanism not shown, which is connected to the caps, is activated to produce a negative pressure which is then introduced into the caps. The negative pressure forcibly draws bubbles accumulated in the print head out of the ejection openings 3*a* along with ink into the caps. The suction-based recovery mechanisms 7*a*, 7*b* can be operated independently of each other so that the suction-based recovery operation can be performed on a selected nozzle group, as required.

The suction-based recovery operation may be followed by other forms of recovery operation, such as the wiping operation to remove ink adhering to the ejection opening formation face 3*b* and the preliminary ejection operation to expel unwanted residual ink in the nozzles. Combining the suction-based recovery operation with other forms of recovery operation in this way can further improve the ejection performance of the print head 3.

In this embodiment, a temperature rise of the print head 3 caused by the preliminary ejection is measured and, based on the measurement, a decision is made as to whether or not the suction-based recovery operation needs to be performed by the automated timer recovery control. This decision procedure is also called "suction-based recovery operation necessity decision procedure".

The temperature rise of the print head 3 caused by the preliminary ejection is detected as follows. First, the carriage 2 is moved until the ejection openings 3*a* of the print head 3 face the suction-based recovery mechanisms 7*a*, 7*b*, as shown in FIG. 2. Then, the print head 3 is activated through the drive circuit 107 to expel ink not contributing to image printing from the nozzles out into the caps (preliminary ejection). A temperature rise of the print head 3 caused by this preliminary ejection is measured by the head temperature sensor 111. Based on the measurement, it is checked whether the suction-based recovery operation needs to be performed by the automated timer recovery control, as described later.

Next, an example of the automated timer recovery control will be described in detail.

(First Example of Automated Timer Recovery Control)

Figure 4:
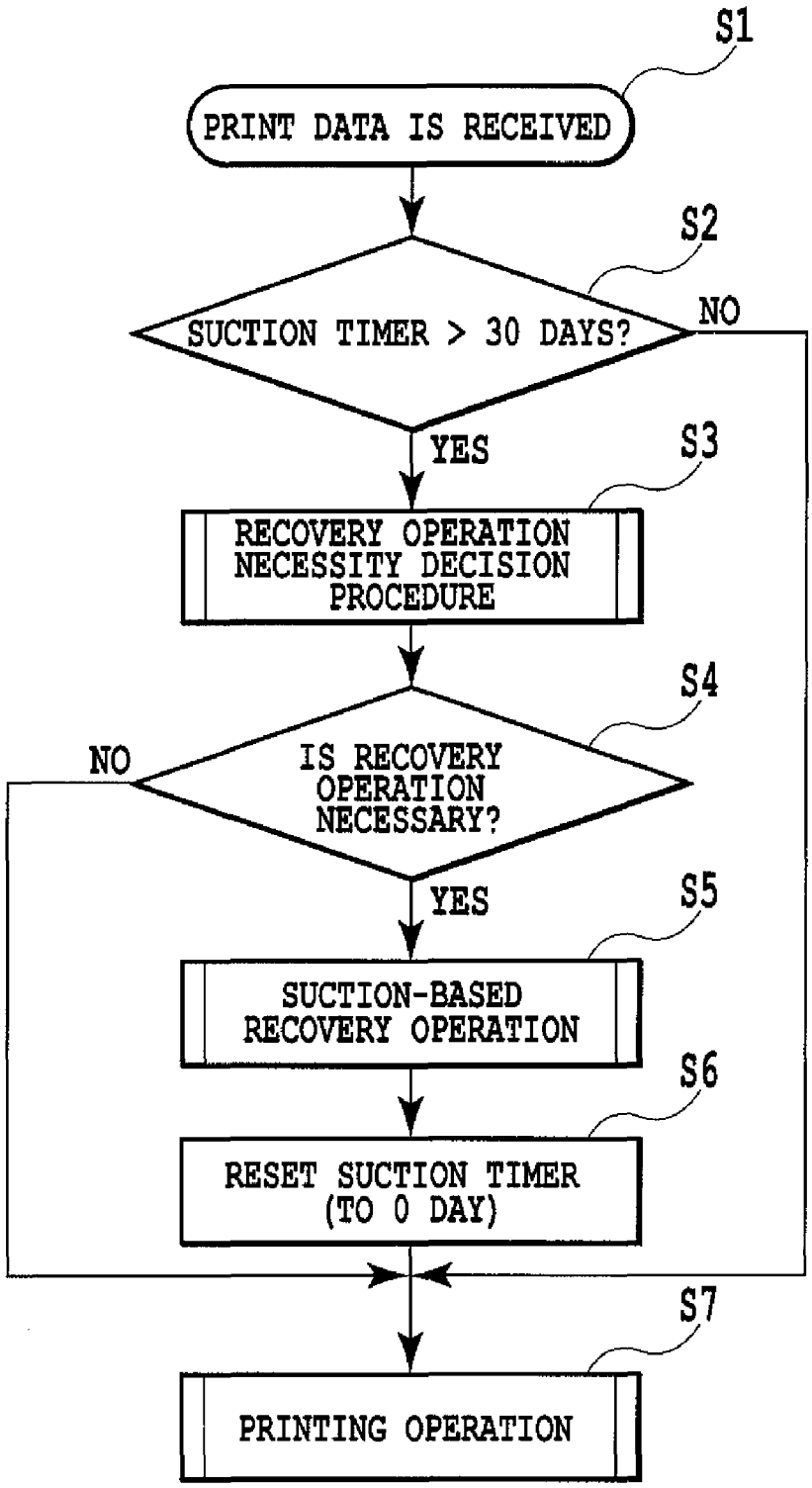
FIG. 4 is a flow chart showing a sequence of steps in a first example of an automated timer recovery control according to this invention.

FIG. 4 is a flow chart showing a first example of the automated timer recovery control.

Upon receiving the print data from the host computer 114 (step S1), the main control unit 100 checks the clocked time of the suction timer 115 and makes a decision on whether or not it is time to perform the recovery operation by the automated timer recovery control (step S2). In this example, if the clocked time of the suction timer 115 is less than 30 days, i.e., if the elapsed time after the previous suction-based recovery operation is less than 30 days, the amount of air accumulated in the print head 3 is small and considered not to influence the ink ejection performance. In this case therefore, there is no need to perform the recovery operation by the automated timer recovery control and the printing operation is started (step S7). If 30 or more days have passed since the previous suction-based recovery operation, the amount of air accumulated in the print head 3 is large and may influence the ink ejection performance. At this time, however, the automated timer recovery control is not immediately executed and, at the next step S3, it is further checked whether the recovery operation needs to be performed by the automated timer recovery control. That is, the "suction-based recovery operation necessity decision procedure" is initiated. More specifically, the temperature rise of the print head 3 caused by the preliminary ejection is detected by the head temperature sensor 111. Then, based on the measurement, a decision is made as to whether the recovery operation needs to be performed by the automated timer recovery control (step S4).

Figure 5:
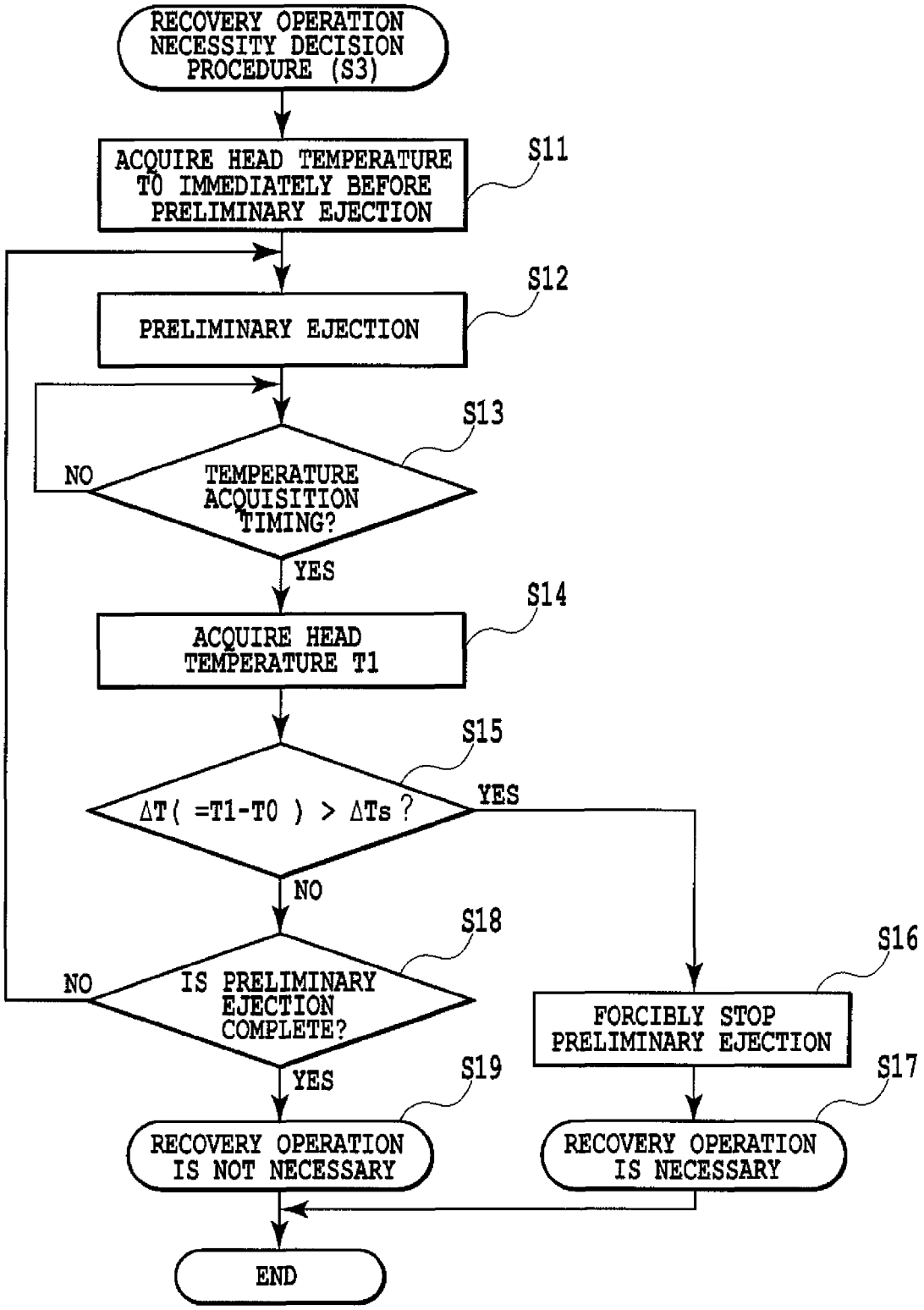
FIG. 5 is a flow chart showing a sequence of steps in deciding whether or not the recovery operation of FIG. 4 needs to be executed.

FIG. 5 is a flow chart showing the "recovery operation necessity decision procedure (step S3)". Here, of the six nozzle groups formed in the print head 3, those nozzle groups that eject a cyan ink are considered. Whether the ejection openings 3*a* of these nozzle groups need to be subjected to the recovery operation is supposed to be decided. The same also applies to other nozzle groups.

First, a temperature T0 of the print head 3 immediately before starting a preliminary ejection is detected by the head temperature sensor 111 and acquired (step S11). Then, as described above, an ink not contributing to image printing is expelled from the ejection openings 3*a* of the print head toward the caps (preliminary ejection) (step S12). The preliminary ejection is performed a plurality of times (e.g., 1,000 times per one election opening). When a predetermined length of time has passed from the first preliminary ejection and a temperature acquisition timing described later has come (step S13), a temperature T1 of the print head 3 is detected by the head temperature sensor 111 and acquired (step S14).

A temperature difference between the acquired temperatures T0 and T1 of the print head 3, that is, a temperature rise $\Delta T$ (=T1−T0) of the print head caused by the preliminary ejection, is determined and compared to a threshold $\Delta Ts$ in the threshold table of FIG. 6 (step S15). The threshold $\Delta Ts$ varies depending on the temperature T1 acquisition timing. The longer the elapse time from the start of the first preliminary ejection to the temperature T1 acquisition timing, the higher the threshold $\Delta Ts$.

In this example, a predetermined number of preliminary ejections are performed in one second (e.g., 10,000 preliminary ejections) and the temperature T1 of the print head 3 is detected each time a predetermined duration of time, 0.1 second, elapses after the start of the first preliminary ejection. That is, the temperature T1 acquisition timing is set at 0.1 second intervals and at each acquisition timing the temperature rise $\Delta T$ of the print head 3 is determined. The threshold ΔTs is set for each acquisition timing. The threshold ΔTs can be set at an optimal value for each color of ink ejected from the ejection openings.

Then, the temperature rises ΔT detected successively at predetermined elapsed times from the start of the preliminary ejection are compared to the thresholds ΔTs corresponding to the temperature acquisition timings (step S15). If the temperature rise ΔT exceeds the corresponding threshold ΔTs, it is determined that trapped air accumulated in the print head 3 has caused ink ejection failures during the preliminary ejections, increasing the temperature rise ΔT of the print head 3. That is, it is considered that, because the energy consumed by the ink ejection has become smaller than the energy injected into the print head 3 for ink ejection, the temperature rise ΔT of the print head 3 has become large. It is therefore decided that the recovery operation needs to be done at this time.

If on the other hand the temperature rise ΔT is not more than the threshold ΔTs corresponding to the temperature acquisition timing, the influence of the air accumulated in the print head 3 is considered small. That is, it is considered that because the energy consumed by the ink ejection has become larger than when there are ink ejection failures, the temperature rise ΔT of the print head 3 has decreased compared with that of the print head 3 that was in the ink ejection failure state. So, it is decided that in this case there is no need to perform the recovery operation even though the time has come for the automated timer recovery control to perform the recovery operation.

If the temperature rise ΔT exceeds the threshold ΔTs corresponding to the temperature acquisition timing, the preliminary ejection is forcibly stopped immediately (step S16). For example, when the temperature rise ΔT 0.5 second after the start of the preliminary ejection has exceeded the threshold ΔTs (15° C.) corresponding to the temperature acquisition timing, the subsequent preliminary ejections are not performed. It is decided, following the step S16, that the recovery operation needs to be performed (step S17).

If, on the other hand, the temperature rise ΔT is not more than the threshold ΔTs corresponding to the temperature acquisition timing, the preliminary ejection (e.g., a preliminary ejection session consisting of 1,000 ejections) is continued (step S18). That is, the detection of temperature rise ΔT at each temperature acquisition timing and the comparison between the temperature rise ΔT and the associated threshold ΔTs corresponding to the temperature acquisition timing are continued. If, after the preliminary ejection session consisting of a predetermined number of ejections is finished (step S18), the temperature rise ΔT at any temperature acquisition timing is not more than the associated threshold ΔTs, it is decided that there is no need to perform the recovery operation (step S19).

After the "recovery operation necessity decision procedure (step S3)" is completed, the control unit proceeds to step S4 of FIG. 4 where, if step S17 has decided the recovery operation is necessary, the control unit executes the suction-based recovery operation (step S5). After the suction-based recovery operation is performed, the suction timer 115 is reset to start clocking from "0" (step S6) before starting a printing operation (step S7). If step S19 decides there is no need for recovery operation, the printing operation is started without performing the suction-based recovery operation (step S7).

In this example as described above, if, in starting the printing operation, the timing for the automated timer recovery control to perform the recovery operation has already passed, the recovery operation necessity decision procedure of FIG. 5 makes a decision on the necessity of the recovery operation. If it is decided that the recovery operation needs to be done, the recovery operation is performed; and if not, the recovery operation is not performed before the printing operation is initiated. This makes it possible to maintain the ejection performance of the print head whatever the condition of use on the part of the user. Further, by performing the recovery operation by the automated timer recovery control, the volume of ink discarded by the recovery operation can be reduced.

While this example has described the automated timer recovery control of FIG. 4 to be executed upon receiving print data, the automated timer recovery control may be performed as one of initial operations automatically executed when the printing apparatus is powered on.

Further, from among a plurality of recovery operations with different discharge volumes of ink, an appropriate recovery operation can be chosen and executed. For example, in discharging dirt and ink of increased viscosity and density from the nozzles of the print head, a recovery operation that expels a relatively small volume of ink is performed at the end of the printing operation. When refreshing the ink in the nozzles and the common liquid chamber of the print head, a recovery operation that expels a larger volume of ink than the relatively-small-discharge-ink-volume recovery operation is performed. Further, when the ink in the print head has such a high viscosity and density that the above recovery operations cannot recover the normal ejection state, a recovery operation discharging a relatively large volume of ink from the print head is executed. When expelling air trapped in the ink supply path running from the ink tank to the print head, a recovery operation that discharges a relatively large volume of ink is preferably executed. In this example, when the automated timer recovery control is decided to be performed, an appropriate recovery operation needs only to be selected from among a plurality of recovery operations with different ink discharge volumes. In a printing apparatus capable of executing a plurality of recovery operations with different ink discharge volumes, as in the case of this example, it is preferred that the suction timer be reset at step S6 of FIG. 4 when a recovery operation to purge air accumulated in the print head is selected and executed.

(Second Example of Automated Timer Recovery Control)

Figure 7:
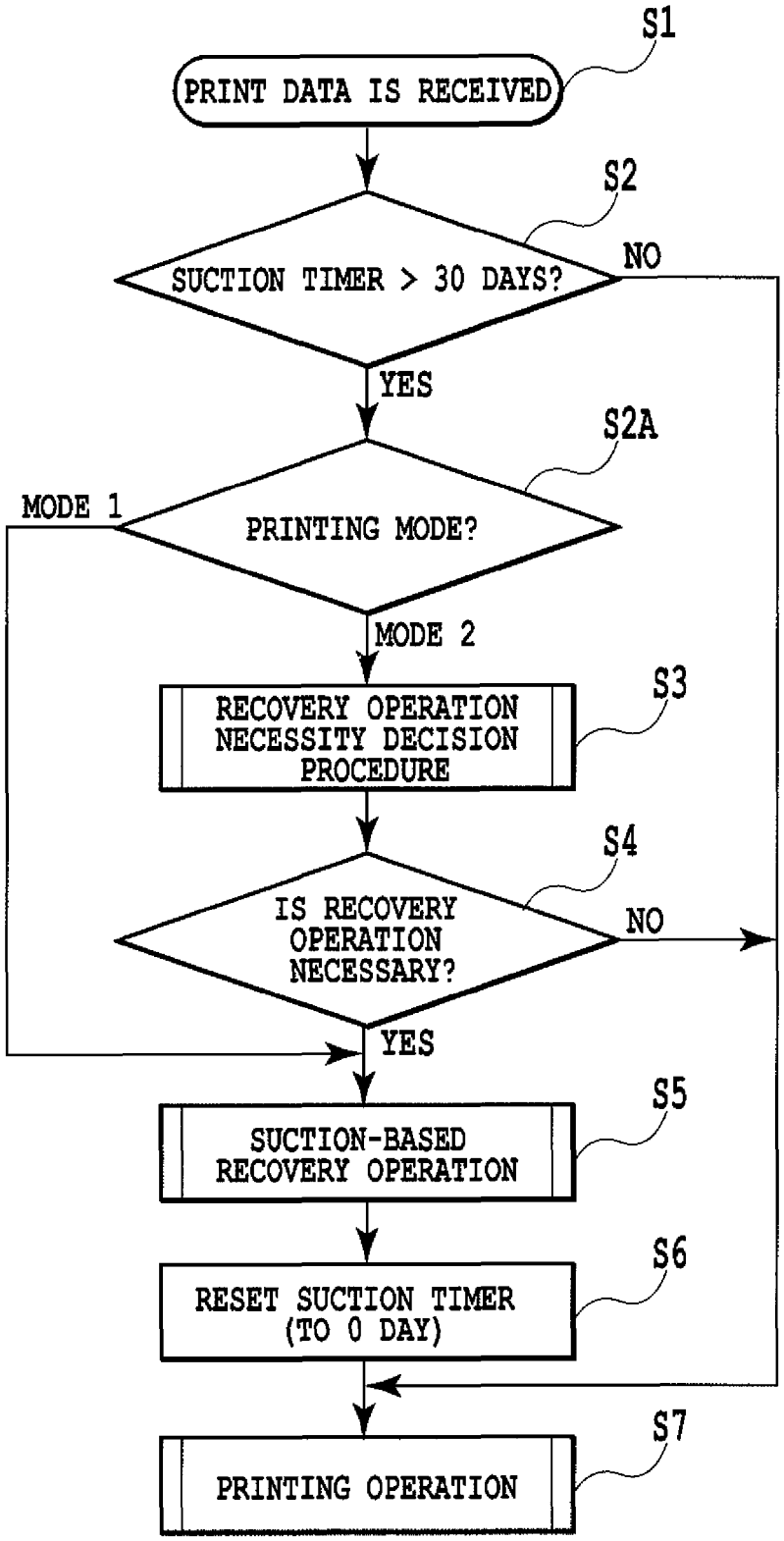
FIG. 7 is a flow chart showing a sequence of steps in a second example of an automated timer recovery control according to this invention.

FIG. 7 is a flow chart showing a second example of the automated timer recovery control. Steps similar to those of the first control example of FIG. 4 are assigned the same step numbers.

Now, the condition of use of the printing apparatus on the part of the user is considered. If, for example, the number of sheets of the print medium P printed over the past month is small, the volume of ink discarded by the recovery operations performed by the automated timer recovery control may exceed the volume of ink consumed by the printing operation. In such a case, the time intervals at which to execute the recovery operation by the automated timer recovery control should be changed to reduce the ink volume discarded by the recovery operation. If the number of sheets of the print medium P printed in the past month is large, the recovery operation by the automated timer recovery control should be performed at appropriate time intervals to keep the desired ejection performance at all times. In that case, from the standpoint of improving throughput, it is desirable not to perform the recovery operation necessity decision procedure of step S3. Changing the mode of the automated timer recovery control according to the number of sheets printed in the past month, as described above, allows for a control that best matches the state of printing (condition of use of the printing apparatus) on the part of the user.

With the above discussions considered, this example performs a printing mode decision procedure described later to determine a state of printing on the part of the user (also referred to as a "printing mode") from the number of sheets printed in the past month and, based on the decision made, changes a mode of the automated timer recovery control.

Figure 8:
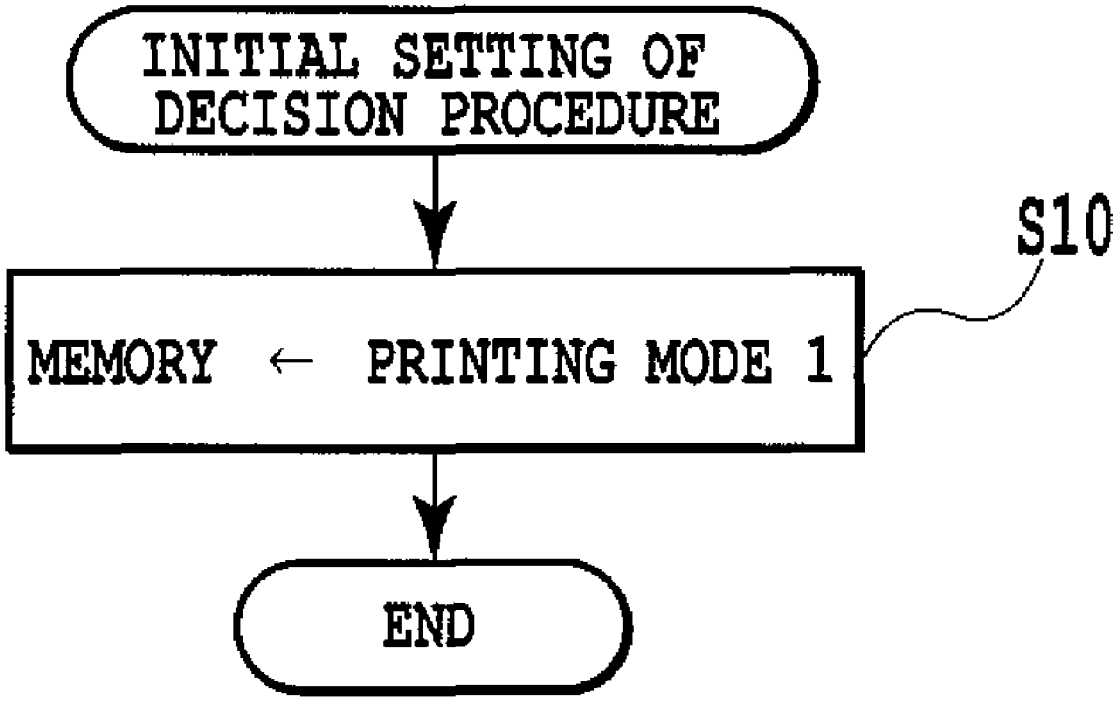
FIG. 8 is a flow chart showing a sequence of steps for initial setting of a print mode used in the control example of FIG. 7.
Figure 9:
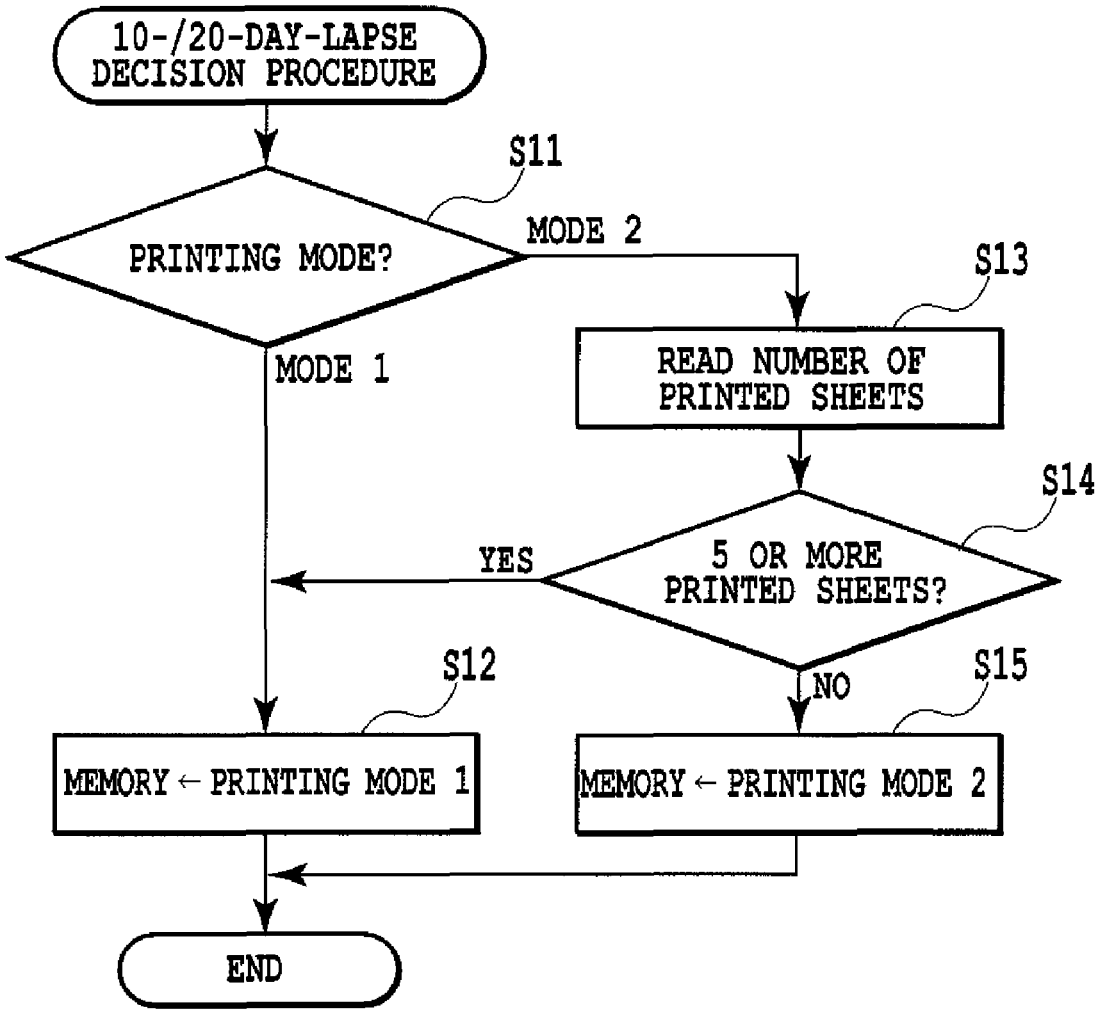
FIG. 9 is a flow chart showing a sequence of steps for determining a print mode when 10 days has elapsed and a sequence of steps for determining a print mode when 20 days has elapsed, these print modes being used in the control example of FIG. 7.
Figure 10:
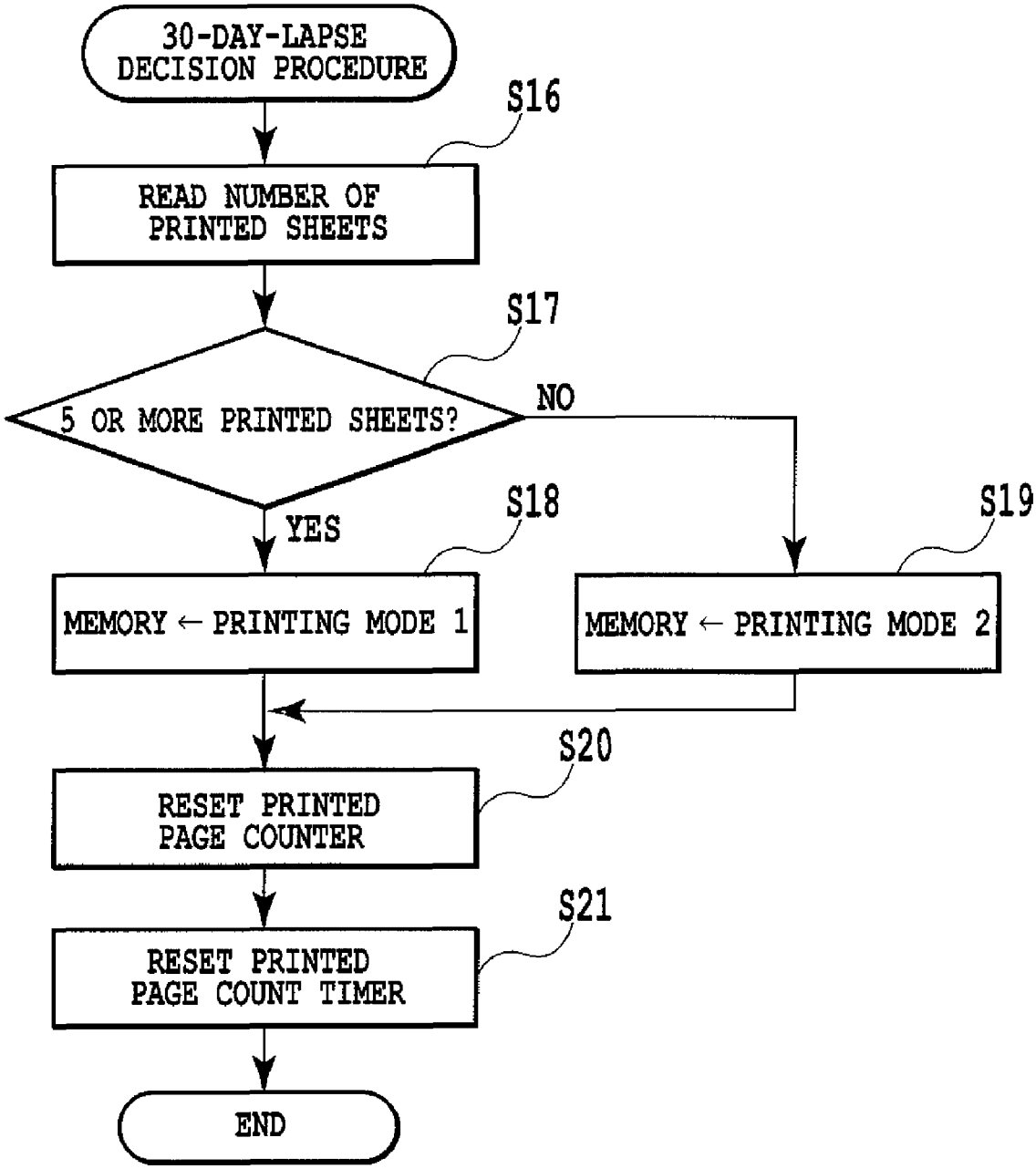
FIG. 10 is a flow chart showing a sequence of steps for determining a print mode when 30 days has elapsed, the print mode being used in the control example of FIG. 7.

FIG. 8 to FIG. 10 show flow charts for determining a printing mode.

The printing apparatus determines the printing mode by this decision procedure irrespective of the reception of print data and writes the decision result into the memory 118. The printing mode decision procedure is executed when the clocked time of the printed page count timer 116 has reached 10 days, 20 days and 30 days. As described earlier, the printed page count timer 116 of this example has already started at the shipping of the printing apparatus and its clocked time is cleared every 30 days. Therefore, the printing mode decision procedure is executed when 10, 20 and 30 days have passed from the start of counting by the printed page count timer 116. Then, the printed page count timer 116 is cleared and the printing mode decision procedure is again executed 10, 20 and 30 days later. Since the printed page count timer 116 is cleared every 30 days, the printing mode decision procedure performed at an elapsed time of 10 days (FIG. 9) from the timer resetting, the printing mode decision procedure performed at an elapsed time of 20 days (FIG. 9) and the printing mode decision procedure performed at an elapsed time of 30 days (FIG. 10) are cyclically repeated.

The decision procedure checks if the printing mode is a printing mode 1 or a printing mode 2 and writes the check result in the memory 118. The print mode 1 is a mode in which a relatively large number of sheets are printed and the print mode 2 is a mode in which a relatively small number of sheets are printed.

First, when the printed page count timer 116 is started, an initial setting of the decision procedure of FIG. 8 writes the printing mode 1 in memory 118 (step S10).

Then, in the decision procedure of FIG. 9 performed at an elapsed time of 10 days, if the printing mode 1 is found to be written in the memory 118, it is left as is (step S11, S12). If a printing mode 2 is found to be written in the memory 118, a count value of the printed page counter 117 at that time, i.e., the number of sheets of the print medium P printed during the elapsed 10 days, is read (step S11, S13). Then, if the number of printed sheets is 5 or more, the printing mode 1 is left as is in the memory 118 (step S14, S12). If, on the other hand, the number of printed sheets is not 5 or more, the printing mode written in the memory 118 is changed to a printing mode 2 (step S14, S15).

Then, the decision procedure performed at an elapsed time of 20 days is similar to the decision procedure of FIG. 9 performed at an elapsed time of 10 days, except that the number of sheets read at step S13 is the number of sheets of the print medium P printed during the past 20 days.

Then, in the decision procedure of FIG. 10 performed at an elapsed time of 30 days, a count value of the printed page counter 117 at that time, i.e., the number of sheets of the print medium P printed during the past 30 days, is read (step S16). Then, if the number of printed sheets is 5 or more, a printing mode 1 is written into the memory 118 (step S18). If, on the other hand, the number of printed sheets is not 5 or more, a printing mode 2 is written into the memory 118 (step S19). After the printing mode 1 or printing mode 2 has been written into the memory 118, the printed page counter 117 and the printed page count timer 116 are reset (step S20, S21). The reset printed page counter 117 restarts counting from "0 sheet" and the reset printed page count timer 116 restarts clocking from "0 days".

As described above, the decision procedure of FIG. 9 performed at an elapsed time of 10 days decides that the printing mode is a printing mode 1 representing a relatively large number of printed sheets when the number of sheets printed during the past 10 days is 5 or more. If on the other hand the number of sheets printed during the past 10 days is not 5 or more, the decision procedure decides that the printing mode is a printing mode 2 representing a relatively small number of printed sheets. Similarly, the decision procedure of FIG. 9 performed at an elapsed time of 20 days decides that the printing mode is a printing mode 1 when the number of sheets printed during the past 20 days is 5 or more. If on the other hand the number of sheets printed during the past 20 days is not 5 or more, the decision procedure decides that the printing mode is a printing mode 2.

Similarly, the decision procedure of FIG. 10 performed at an elapsed time of 30 days decides that the printing mode is a printing mode 1 when the number of sheets printed during the past 30 days is 5 or more. If on the other hand the number of sheets printed during the past 30 days is not 5 or more, the decision procedure decides that the printing mode is a printing mode 2. In the decision procedure performed at an elapsed time of 30 days, the printed page counter 117 and the printed page count timer 116 are reset.

The printing mode decision procedure described above is separate from the automated timer recovery control of FIG. 7 in this example.

The automated timer recovery control of FIG. 7 in this example performs the following sequence of steps. First, upon receiving print data from the host computer 114 (step S1), the main control unit references a clocked time of the suction timer 115 to check whether it is time to perform the automated timer recovery operation (step S2). If the clocked time of the suction timer 115 is not more than 30 days, it is considered that the amount of air trapped in the print head 3 is small and will not influence the ink ejection performance and that a suction-based recovery operation therefore does not need to be performed. So, the printing operation is started (step S7). If the clocked time of the suction timer 115 is 30 days or more, there is a possibility that a large volume of air accumulated in the print head 3 may influence the ink ejection performance.

In this example, if the clocked time of the suction timer 115 is 30 days or more, a printing mode in the memory 118 written by the printing mode decision procedure is read and it is checked whether the printing mode is 1 or 2 (step S2A). In step S2A the printing mode read in refers to a printing mode already written in the memory 118 at that time. That is, the printing mode is the one that was written in the memory 118 either by the initial setting (FIG. 8), by the decision procedure performed at an elapsed time of 10 days (FIG. 9), by the decision procedure performed at an elapsed time of 20 days (FIG. 9) or by the decision procedure performed at an elapsed time of 30 days (FIG. 10).

If a printing mode 2 representing a small number of printed sheets is already written in the memory 118, the main control unit proceeds to the recovery operation necessity decision procedure (step S3), as in the first control example. In this case, as in the first control example, the suction-based recovery operation (step S5) is executed provided that the recovery operation necessity decision procedure (step S3) decides that the recovery operation is necessary (step S4). When the number of printed sheets is small, the volume of ink discarded by the recovery operation performed by the automated timer recovery control tends to be large when compared with the ink volume consumed by the printing operation. During the printing mode 2 in which a small number of sheets are printed, this example performs the recovery operation only when a predetermined condition is met. This in turn reduces the ink volume discarded by the recovery operation and minimizes the running cost.

If on the other hand a printing mode 1—in which a large number of sheets are printed—is written, the suction-based recovery operation (step 5) is performed without checking the necessity of the recovery operation by the recovery operation necessity decision procedure (step S3). In the printing mode 1 in which a large number of sheets are printed, it is desired that, after a predetermined period (in this example, 30 days) has passed, the automated timer recovery control perform a recovery operation to maintain the ink ejection performance. Further, not executing the recovery operation necessity decision procedure (step S3) is conducive to the improvement of throughput.

In this example, the printing mode decision procedure is executed every 10 days—shorter than 30 days at the interval of which the recovery operation is performed by the automated timer recovery control. That is, the printing mode decision procedure is executed at an elapsed time of 10 days, 20 days and 30 days. Each decision procedure determines the printing mode based on a result of comparison between the number of printed sheets and a predetermined threshold (in this example, 5 sheets). Therefore, depending on the state of use of the printing apparatus, the printing mode may be changed in the 10-day-lapse decision procedure, in the 20-day-lapse decision procedure and in the 30-day-lapse decision procedure. For example, if a printing mode 2 is written in the 10-day-lapse decision procedure and if, during the 20-day-lapse decision procedure, the number of printed sheets exceeds five, the 20-day-lapse decision procedure rewrites the printing mode with the printing mode 1. Therefore, the printing mode is checked and changed according to the state of use of the printing apparatus at shorter intervals than those at which the recovery operation is performed by the automated timer recovery control.

As described above, this example enables either the printing mode 1 control or the printing mode 2 control to be executed according to the state of use (printing state) of the printing apparatus on the part of the user. That is, a printing apparatus used by a user who has a relatively large print volume can perform a printing mode 1 control, in which the recovery operation to maintain the ejection performance is performed at predetermined intervals by the automated timer recovery control, with priority given to throughput. In a printing apparatus used by a user who has a relatively small print volume, a printing mode 2 control is executed which reduces the discarded ink volume and gives priority to a reduction in the running cost while maintaining the ejection performance of the print head.

(Third Example of Automated Timer Recovery Control)

When a printing apparatus is first powered on after shipment from factory, a count value of the printed page counter 117 is "0". The printed page count timer 116 starts counting at time of shipment from factory. So, simply executing the decision procedure of FIG. 10 30 days after the shipment would determine the printing mode to be a printing mode 2. That is, immediately after the printing apparatus is installed, the printing mode 2 control is performed. However, since immediately after the installation of the printing apparatus, the user is likely to print a relatively large number of sheets, a control in printing mode 1 is preferred.

In this example, during 30 days after the power of the printing apparatus has been turned on for the first time following the shipment from factory, the printing mode is set to a printing mode 1 whatever the count value of the printed page counter 117. For example, after the initial setting of FIG. 8 in the second control example described above, the time when the power of the printing apparatus was turned on for the first time is taken as a reference point. Ten days, 20 days and 30 days after the reference point, the decision procedures of FIG. 9 and FIG. 10 are performed. This allows a printing mode 1 control to be executed during the 30 days from when the power of the printing apparatus was turned on for the first time. Generally, whether the power-on of the printing apparatus is the first time after shipment is determined by using a flag. If the power of the printing apparatus is found to be turned on for the first time after the shipment, a special operation such as filling ink into the print head is performed. With the use of such a flag, it is therefore possible to detect when the power of the printing apparatus is turned on for the first time after shipment. From the point of detection until a predetermined period elapses, a printing mode 1 control can be performed.

Further, for overseas transport a printing apparatus may be put in a transport state in which a print head is cleared of ink by a user or manufacturer. In such a case, a control should preferably be performed in the same way as when the printing apparatus is powered on for the first time after shipment. That is, from when the power of the printing apparatus was first turned on following the transport until a predetermined period (e.g., 30 days) passes, a printing mode 1 control is preferably performed.

(Fourth Example of Automated Timer Recovery Control)

Figure 11:
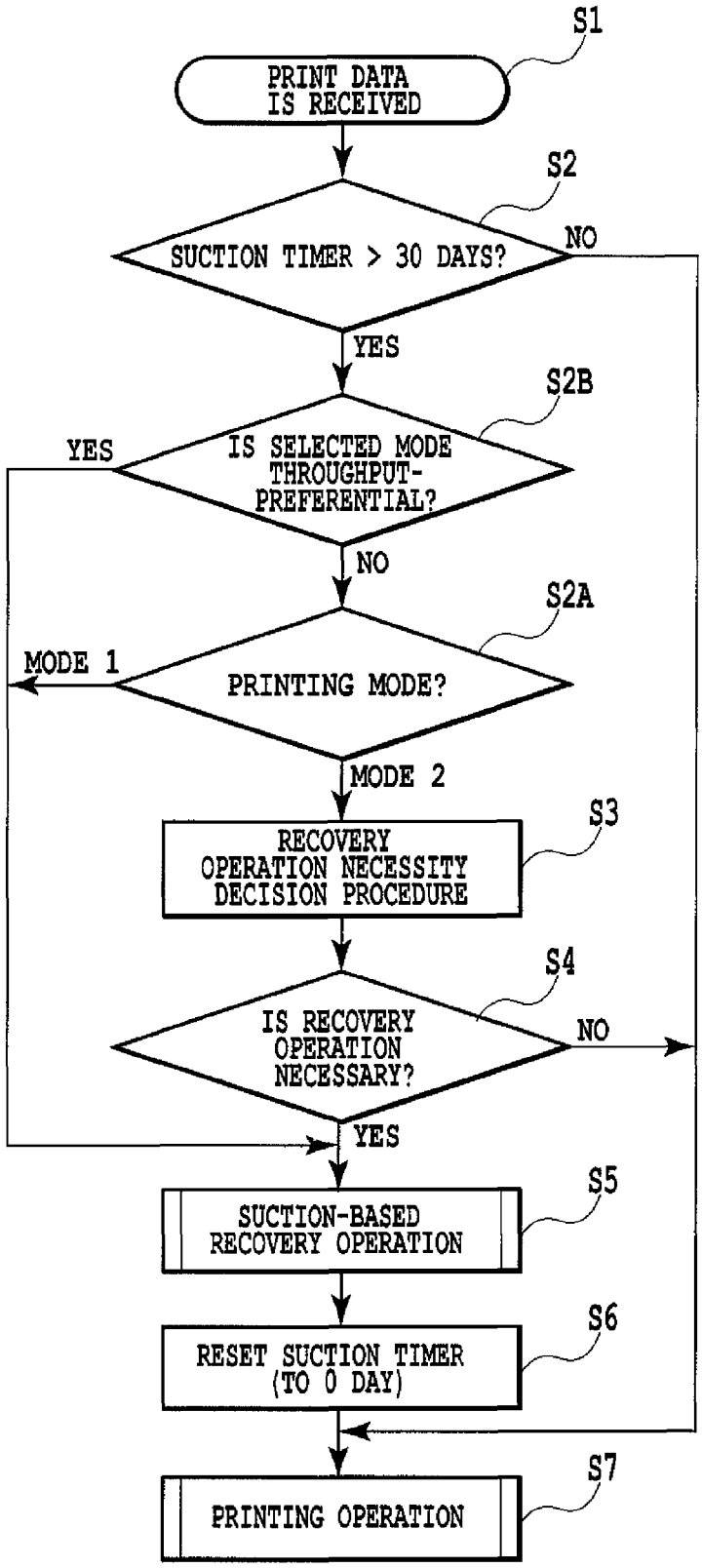
FIG. 11 is a flow chart showing a sequence of steps in a fourth example of an automated timer recovery control according to this invention.

FIG. 11 is a flow chart showing a fourth example of the automated timer recovery control. Steps identical with those of the first and second control example described above are given the same step numbers.

Upon receiving print data from the host computer 114 (step S1), the main control unit checks a clocked time of the suction timer 115 to see if it is time to execute the automated timer recovery operation (step S2). If the clocked time of the suction timer 115 is not more than 30 days, air accumulated in the print head 3 is small in volume and does not influence the ink ejection performance, which means that there is no need to perform the suction-based recovery operation. So a printing operation is started (step S7). If, however, the elapsed time of the suction timer 115 is 30 days or more, air trapped in the print head 3 is large in volume and may influence the ink ejection performance.

This example has, in addition to the configuration of the first control example described above, a capability to allow the user to select the printing mode 1. When he or she wishes to give priority to throughput at all times in the execution of a recovery operation by the automated timer recovery control, the user can select the printing mode 1 without executing the recovery operation necessity decision procedure (step S3). The method for the user to select the printing mode 1 giving priority to throughput includes, for example, using an operation panel mounted on the printing apparatus body. The method of selecting the printing mode is not limited to this method and other methods may be used. For example, a driver or utility software may be used. In the case of a printing apparatus connected to network, Web may be used.

Whether the user has chosen the printing mode 1 that gives priority to throughput is determined by step S2B. If the printing mode 1 is chosen, the suction-based recovery operation is performed by the automated timer recovery control (step S5) and the suction timer 115 is reset (step S6) before starting a printing operation (step S7). If the user has not selected the printing mode 1, the similar process to the second control example is performed.

As described above, this example has, in addition to the configuration of the second control example, a capability to allow the user to select a throughput preferential mode (printing mode 1). Therefore, in addition to the control of the second control example, it is possible with this example to perform an optimal control to meet the requirement of the user who wishes to give preference to throughput.

(Other Embodiments)

This invention can be applied not only to the serial scan type printing apparatus described above but also to so-called line type printing apparatus. In the case of the line type printing apparatus, a long print head is used which extends in a width direction of a print medium over an entire print area. The print head and the print medium are moved relative to each other in one direction as ink is ejected from the print head onto the print medium, thus forming an image. That is, the present invention can be applied widely to a variety of types of ink jet printing apparatus that use a print head capable of ejecting ink from a plurality of ejection openings to form an image on a print medium.

The recovery operations may include a pressure-based recovery operation that applies a pressure to ink in the print head to expel ink not contributing to image forming from the ejection openings, as well as the suction-based recovery operation, preliminary ejection operation and wiping operation described above. What is required of the recovery operation is to keep the ink ejection of the print head in good condition.

The automated timer recovery control described above needs only to be able to activate a recovery unit prior to the printing operation that forms an image on a print medium, each time a predetermined period (first predetermined period) set in a suction timer as the first timer elapses. The recovery operation performed by the automated timer recovery control is not limited to the suction-based recovery operation. The recovery operation is preferably able to replace an ink present in portions of the print head where air may be trapped with an ink fit for printing. For example, a suction-based recovery operation that sucks out a relatively large volume of ink from the ejection openings of the print head (heavy recovery operation) should preferably be performed. The portions within the print head where air may be trapped include nozzles and liquid paths in the print head and tubes. Further, during the printing operation, a suction-based recovery operation that sucks out a relatively small volume of ink (light recovery operation), a preliminary ejection operation and a wiping operation may be performed as recovery operations to expel viscous ink from the print head.

In the recovery operation necessity decision procedure described above, a temperature increase of the print head caused by the preliminary ejection is acquired as information concerning the ink ejection state of the print head. The recovery unit is activated only if the temperature increase of the print head is not more than a predetermined value (first condition). However, the information related to the ink ejection state of the print head is not limited to the temperature increase of the print head. Any other information may be used as long as they can be acquired before activating the recovery unit.

In the second control example described above, a predetermined period (second predetermined period) used by the printed page count timer (second timer) is set to 30 days and the number of sheets of the print medium printed by the printing apparatus during that predetermined period (30 days) is detected as a print volume. Under the condition that the detected print volume is not more than a predetermined number of sheets (second condition), a recovery operation is performed. Further, the number of printed sheets is detected every 10 days (third predetermined period), which is shorter than 30 days. Then, the result of detection obtained every 10 days (third predetermined period) is also considered in determining if the second condition that the number of printed sheets is not more than a predetermined number is met. However, the print volume to be detected may also include an ink ejection volume corresponding to the print data, as well as the number of printed sheets of the print medium. Further, the second and third predetermined period are not limited to 30 days and 10 days but may use other desired periods.

The present invention is applicable to any devices using a variety of print media such as paper, cloth, leather, non-woven cloth, OHP sheets and even metals. Examples of applicable devices include office equipment, such as printers, copying machines and facsimiles, and industrial production machines. Especially the present invention can be applied effectively to equipment for high speed printing an image on larger print media.

A further embodiment of the present invention provides an ink jet printing apparatus to print an image on a print medium (P) by using a print head (3) capable of ejecting ink from a plurality of ejection openings (3*a*), the ink jet printing apparatus comprising:

a recovery unit (7) that performs a recovery operation to maintain an ink ejection performance of the print head (3) when a first predetermined period passed;

a detection unit (117) that detects a print volume printed in a second predetermined period;

an acquisition unit (111) that acquires information on an ink ejection state of the print head (3); and a control unit (100) that performs control in such a manner that, when the first predetermined period passed and the print volume detected by the detection unit (117) is greater than a predetermined print volume, the control unit (100) executes the recovery operation using the recovery unit (7) and that, when the first predetermined period passed and the print volume detected by the detection unit (117) is smaller than the predetermined print volume, the control unit (100) executes the recovery operation using the recovery unit (7) if the recovery operation on the print head (3) is determined necessary based on the information acquired by the acquisition unit (111).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-024723,filed Feb. 2, 2007, which is hereby incorporated by reference herein in its entirety.

What is claimed is:

1. An ink jet printing apparatus comprising:

a recovery unit configured to perform a recovery operation of an ink jet print head;

a detection unit configured to detect a temperature increase of the print head caused by performing a preliminary ejection operation of the print head; and a control unit configured to:

(i) cause the detection unit to detect the temperature increase when a period of time from a previous recovery operation is equal to or greater than a predetermined time, and (ii) cause the recovery unit to perform the recovery operation if the temperature increase is equal to or greater than a predetermined threshold, wherein if the period of time is equal to or greater than the predetermined time and printed sheets printed by the print head in a predetermined period are equal to or greater than a predetermined value, the control unit causes the recovery unit to perform the recovery operation without causing the detection unit to detect the temperature increase.

2. The ink jet printing apparatus according to claim 1, wherein when a period of time from powering on the ink jet printing apparatus for the first time after the ink jet printing apparatus has been shipped is equal to or greater than a predetermined time, the control unit causes the recovery unit to perform the recovery operation without causing the detection unit to detect the temperature increase.

3. The ink jet printing apparatus according to claim 1, further comprising a timer configured to clock the period of time from the previous recovery operation, wherein the timer is reset when the recovery unit performs the recovery operation.

4. The ink jet printing apparatus according to claim 1, wherein the recovery unit has a cap for capping a plurality of ejection openings of the print head and a pump for providing negative pressure into the cap, and wherein ink in the print head is discharged through the plurality of ejection openings by the negative pressure provided into the cap.

5. A recovery operating method for an ink jet printing apparatus having a recovery unit configured to perform a recovery operation of an ink jet print head for printing by ejecting ink and a detection unit configured to detect a temperature increase of the print head caused by performing a preliminary ejection operation of the print head, the recovery operating method comprising:

a detecting step of detecting the temperature increase by the detecting unit when a period of time from a previous recovery operation is equal to or greater than a predetermined time and printed sheets printed by the print head in a predetermined period are less than a predetermined value;

a first recovery step of performing the recovery operation by the recovery unit if the temperature increase is equal to or greater than a predetermined threshold; and a second recovery step of performing the recovery operation by the recovery unit without detecting the temperature increase by the detecting unit when the period of time is equal to or greater than the predetermined threshold and the printed sheets are equal to or greater than the predetermined value.

* * * * *